US007108321B2

(12) United States Patent
Davis

(10) Patent No.: US 7,108,321 B2
(45) Date of Patent: Sep. 19, 2006

(54) PORTABLE FORWARD LEANING STADIUM SEAT

(76) Inventor: Barton Brett Davis, 7608 Parkwood Dr. NW., Albuquerque, NM (US) 87120

( * ) Notice: Subject to any disclaimer, the term of this patent is extended or adjusted under 35 U.S.C. 154(b) by 0 days.

(21) Appl. No.: 10/958,845

(22) Filed: Oct. 4, 2004

(65) Prior Publication Data

US 2006/0071521 A1 Apr. 6, 2006

(51) Int. Cl.
*A47D 1/10* (2006.01)
*A47C 7/54* (2006.01)

(52) U.S. Cl. ..... 297/252; 297/230.1; 297/230.13; 297/352

(58) Field of Classification Search ..... 297/252, 297/256.16, 230.1, 230.13, 352
See application file for complete search history.

(56) References Cited

U.S. PATENT DOCUMENTS

| | | | | |
|---|---|---|---|---|
| 2,508,769 | A * | 5/1950 | Osbon et al. | 297/252 |
| 2,667,913 | A * | 2/1954 | Dustin | 297/252 X |
| 3,994,529 | A | 11/1976 | Lippert | 297/252 |
| 4,611,852 | A | 9/1986 | Filer | 297/352 |
| 4,637,151 | A | 1/1987 | Love | 40/584 |
| 4,715,652 | A | 12/1987 | Ward | 297/252 |
| 4,781,413 | A | 11/1988 | Shumack, Jr. | 297/252 |
| 4,871,209 | A | 10/1989 | Handelman | 297/378 |
| 4,930,838 | A | 6/1990 | Brabant | 297/184 |
| 5,067,771 | A | 11/1991 | Ellis | 297/378 |
| 5,190,344 | A | 3/1993 | Anderson | 297/17 |
| 5,205,610 | A | 4/1993 | Reninger | 297/380 |
| 5,222,782 | A | 6/1993 | Shrader | 297/252 |
| 5,421,637 | A | 6/1995 | Lemburg | 297/188 |
| 5,516,193 | A | 5/1996 | Simpson | 297/252 |
| 5,518,296 | A | 5/1996 | Compardo | 297/378 |
| 5,580,130 | A | 12/1996 | Williams | 297/352 |
| 5,697,628 | A | 12/1997 | Spear | 280/304.1 |
| 5,829,837 | A | 11/1998 | Reiersen | 297/352 |
| 5,915,783 | A | 6/1999 | McDowell | 297/180 |
| 5,944,379 | A | 8/1999 | Yates | 297/129 |
| 6,565,154 | B1 | 5/2003 | Davis | 297/352 |

* cited by examiner

*Primary Examiner*—Rodney B. White

(57) ABSTRACT

A forward leaning stadium seat having a padded seat; a vertical support sleeve with an arm support device and quick release locking clasp to allow quick and easy up and down positioning of the arm support device and an adjustable hub to stop the forward and backward movement of the vertical support device at prescribed locations within a prescribed arc of travel.

29 Claims, 6 Drawing Sheets

PORTABLE FORWARD LEANING STADIUM SEAT

BACKGROUND OF THE INVENTION

1. Field of Invention

The present invention relates to forward leaning seating devices, and in particular to a portable stadium seat that can be used by individuals attending spectator events at facilities having backless bench type seats.

2. Description of the Prior Art

There have been a number of attempts to develop a comfortable and easy to carry portable seat for spectator events with varying success. The prevailing designs have attempted to supply support to the human back while sitting at sporting events through a rearward leaning approach. There are many examples of rearward leaning portable stadium seats.

U.S. Pat. No. 3,994,529 issued to Lippert on Nov. 30, 1976 for a Stadium seat. This early version of a stadium chair assembly included pivot able legs and at least one pivotal holder located to swing downwardly to return the chair to a stadium bench with the legs folded up under the seat. It would not be very comfortable nor easy to handle in a crowded stadium. These designs are ineffective in supplying support to the human spine, while seated at sporting events, because the user of such seating, at such events lean forward to look down from the stadium, thus negating the rearward designed support.

U.S. Pat. No. 4,715,652 issued to Ward on Dec. 29, 1987 for a Portable stadium seat with tray included: a comfortable, lightweight and portable stadium seat with a slidably removable tray for spectator use. The seat contained a back rest and seat bottom portions with cushions attached to interconnected tubular rails so that the seat is collapsible for easy carrying. In addition the tray is mounted under the seat bottom portion in such a manner that it can be pulled out as needed to extend in front of the spectator for holding food and drinks. A safety feature consisting of a spring-loaded hook-like fastener mounted on the bottom of the seat and keeps the seat from tipping over backwards while in use.

U.S. Pat. No. 5,697,628 issued to Spear on Dec. 16, 1997 for a Wheelchair exercise and support bar apparatus and method discloses, an exercise and support bar mounted in brackets on a wheelchair and method for using same. The bar can be adjusted to be more or less proximate the occupant by removing the upstanding portions of the bar from the brackets, turning the apparatus end_for_end, and re-inserting the upstanding portions in the bracket. Angular and height adjustments are also provided by the apparatus. Some of the drawbacks of this design include the difficulty in adjusting the support bar and the lacking portability. Also, this bar would prevent anyone from exiting or entering the seat effectively.

U.S. Pat. No. 6,565,154 to Davis, Barton B. issued May 20, 2003 approached the dilemma of providing adequate back support through a forward leaning concept. His design accomplished proper support to the torso by allowing the user of the seat apparatus to support his trunk by leaning forward and resting his forearms on the padded frontally placed support. This is a highly effective design for trunk support in a forward leaning posture necessary at sporting events while seated at a stadium on backless bleachers, however, several shortcomings to the forward leaning design, as found in the Davis patent, have become apparent. The first is the forward leaning design prevents the user of the apparatus from being able to pick up beverages or other items from under the bleacher, because of the necessary placement of the arm rest. The second shortcoming is the mechanism to adjust the vertical support armature forward and backward as well as up and down is too complex. Thirdly, the seat frame can slide too easily on the stadium bleacher. Fourthly the padding on the arm rests roll around the horizontal support armature making it uncomfortable for the user of the device.

What is needed is a portable forward leaning stadium seat apparatus that is designed to be used with any type backless bench style bleacher and provide a solid attachment that does not slide, has easier adjusting mechanisms to provide variability of positions for the vertical and horizontal support armatures, ergonomically designed arm rests and a convenient cup holder.

SUMMARY OF THE INVENTION

In accordance with the present invention a portable forward leaning stadium seat comprises a seat base connected to a padded seat, which can be firmly attached to a stadium style bleacher, push button quick release adjustable vertical support armature which has padded ergonomic arm rests, convenient cup holder, and nonslip rubberized discs applied to the undersurface of the seat base.

Therefore, it is an object of the present invention to have an improved adjustable forward leaning seating device to allow the torso of spectators at sporting events to sit comfortably, thereby minimizing back pain.

Another object of the present invention is to have an improved forward leaning designed stadium seat that is portable, lightweight, and more comfortable.

A still further object of the present invention is to have a more easily adjustable stadium seat.

Another object of the present invention is to have a stadium seat that does not slide on the bleacher bench.

Another object of the present invention is to provide a stadium seat that has a convenient built in cup holder.

These and other objects of the present invention will become apparent to those skilled in this art from a careful review of the drawings, description and appended claims of this application.

DESCRIPTION OF THE PREFERRED EMBODIMENT

A preferred embodiment of the portable forward leaning stadium seat of the present invention is illustrated in FIG. 1 through 6. The present invention has a skin covered foam pad 10 which is fastened to a quadrilateral shaped polymeric solid substrate 28. The quadrilateral shaped polymeric solid substrate 28 has a front, rear, right, and left side as well as a top surface and bottom surface. The bottom surface of the foam covered solid substrate 28 is attached to the top surface of a polymeric seat frame 12. The polymeric seat frame 12 is shaped to conform with the shape of the quadrilateral shaped solid substrate 28. The polymeric seat frame 12 has a top surface, bottom surface, front portion, rear portion, right side and left side.

Figure 5:
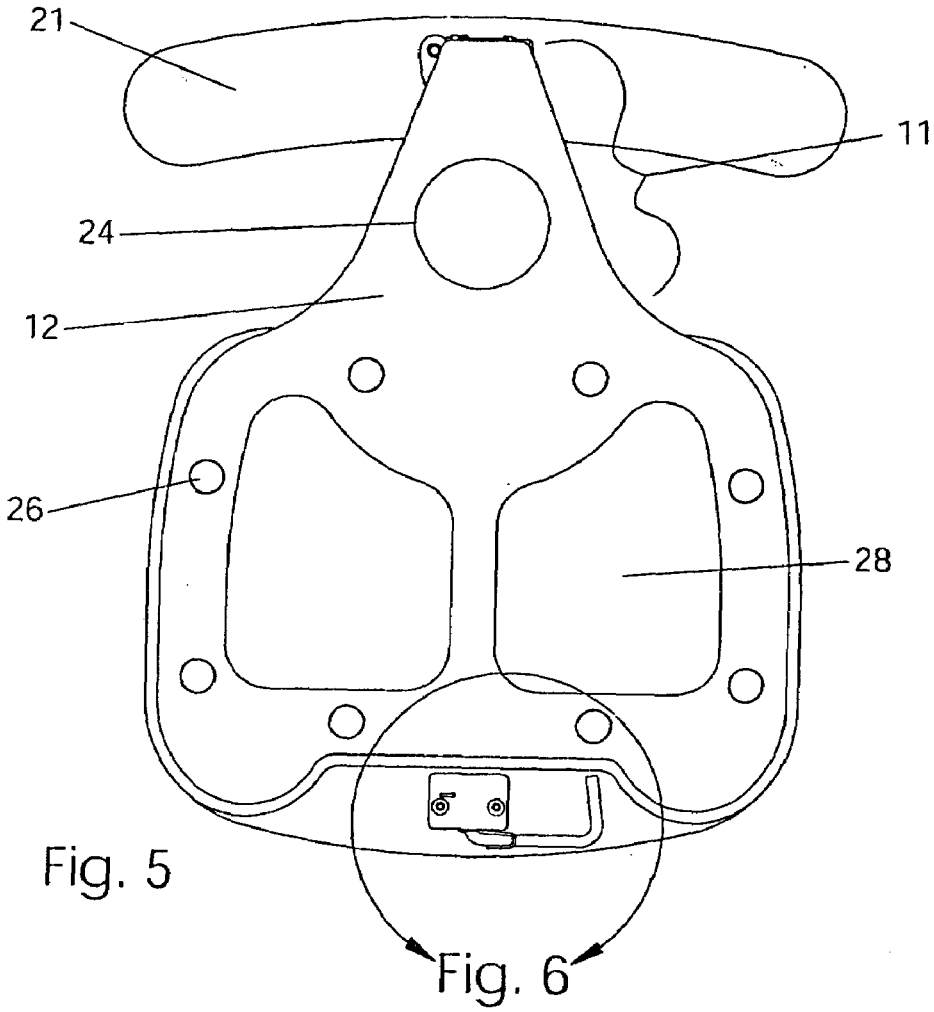
FIG. 5 demonstrates a bottom view of the portable forward leaning stadium seat showing the rubberized no slip buttons fixably attached to the undersurface of the quadrilateral shaped seat frame.
Figure 6:
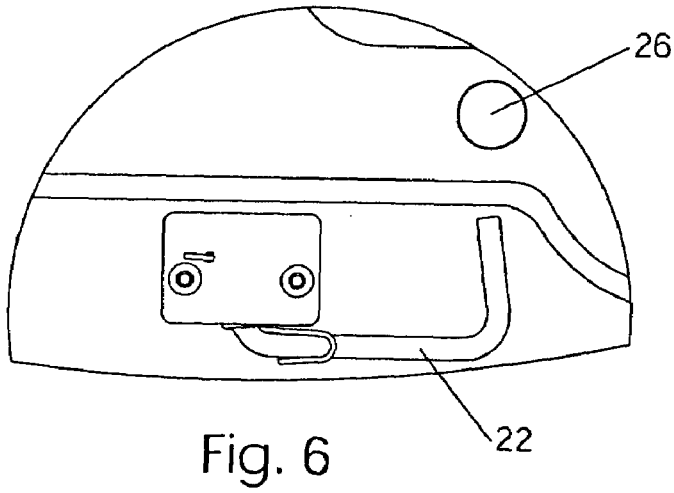
FIG. 6 shows an enlarged detail of the spring loaded hook assembly which is attached to the undersurface of the padded seat substrate.
Figure 7:
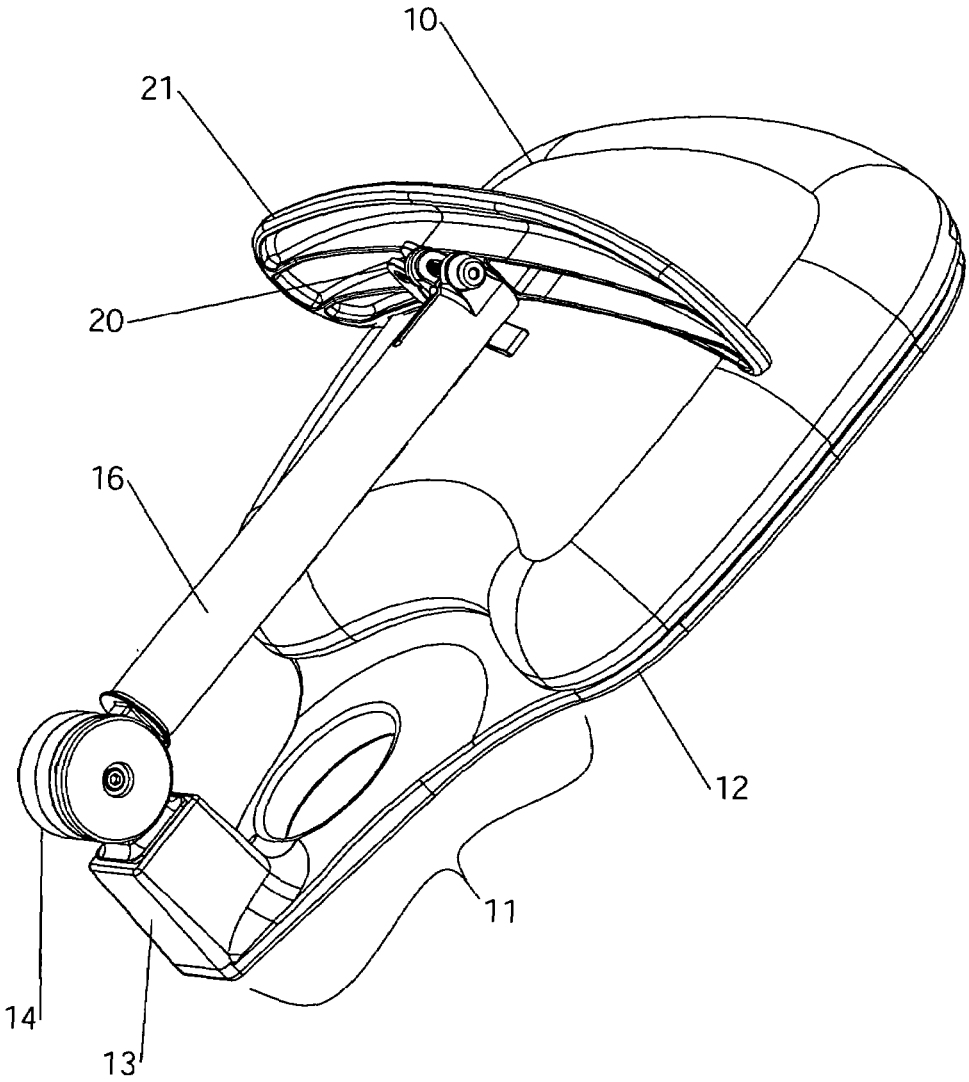
FIG. 7 is a folded and collapsed view of the portable forward leaning stadium seat demonstrating its portability.

As seen in FIG. 5 (bottom view), the front side of the polymeric seat frame 12 has a front cupola projection portion 11. The front cupola projection portion 11 is penetrated with an aperture 24 that is of a size congruent to securely hold a beverage cup. The polymeric seat frame 12 has a central cut out to reduce weight. The rear side of the polymeric seat frame 12 is recessed to allow for the attachment of a spring loaded metal hook 22 as seen in FIG. 6, to the rear undersurface of the polymeric solid substrate 28. The bottom surface of the polymeric seat frame 12 provides attachment sites for rubberized buttons 26 to be adhesively fixed.

Figure 1:
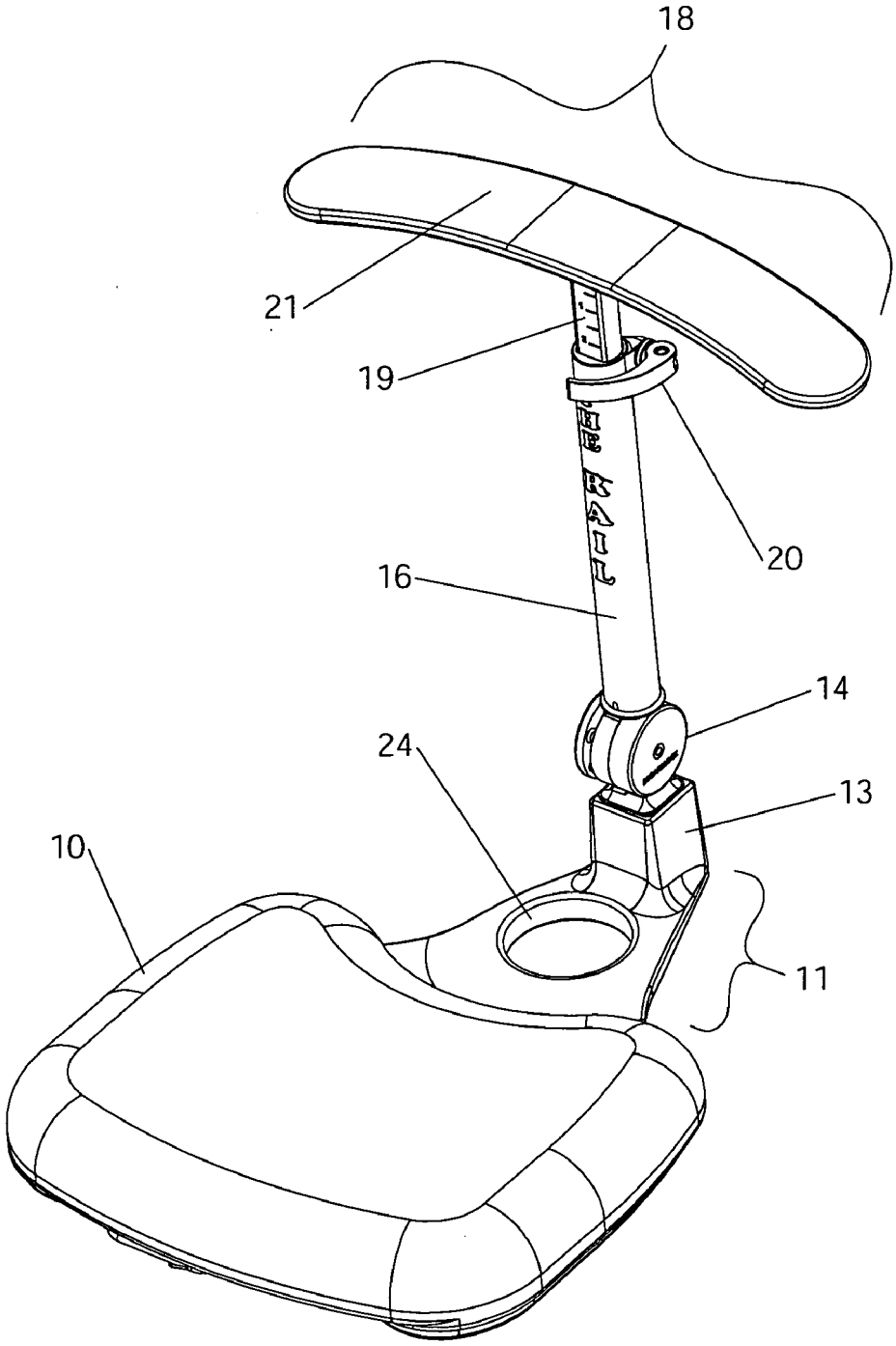
FIG. 1 is a perspective view of the invention showing the adjustable torso support armature in an upright position with the foam seat attached to the seat frame with round opening for placement of beverage cup.
Figure 2:
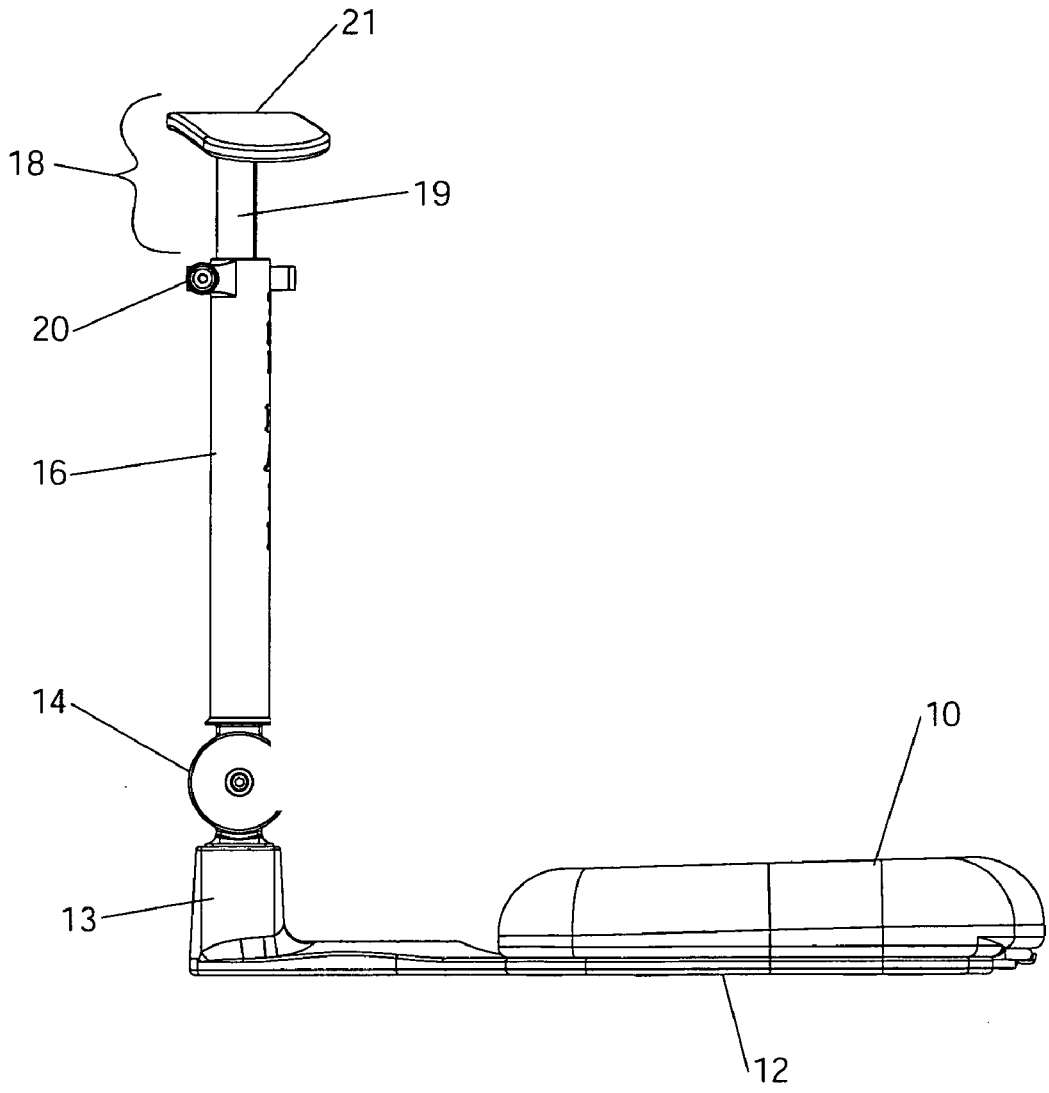
FIG. 2 is a side view of the portable forward leaning stadium seat demonstrating the pushbutton locking hub and quick release locking clasp.

As seen in FIG. 1 (isometric view), the top surface of the polymeric seat frame 12 at the front most edge of the cupola shaped projection 11 has a boxed in attachment site 13 where one end of a push button locking hub 14 is fixed. A hollow tubular vertical support sleeve 16 is matched and adhesively fixed to the other end of the spring loaded push button rotary locking and unlocking device 14. The distal end of the hollow tubular vertical support sleeve 16 has a built in quick release lock clasp 20. The hollow tubular vertical support sleeve 16 has a longitudinal groove 15 that terminates in an aperture 17. The combination of the longitudinal groove 15 and through-hole 17 allows for the quick release lock clasp 20 to compress the distal end of the hollow tubular vertical support sleeve 16, thereby gripping the vertical support shaft 19 which is centrally connected to an ergonomically T-shaped horizontal arm rest 21 and is of a smaller diameter than the hollow tubular vertical support sleeve 16.

Figure 3:
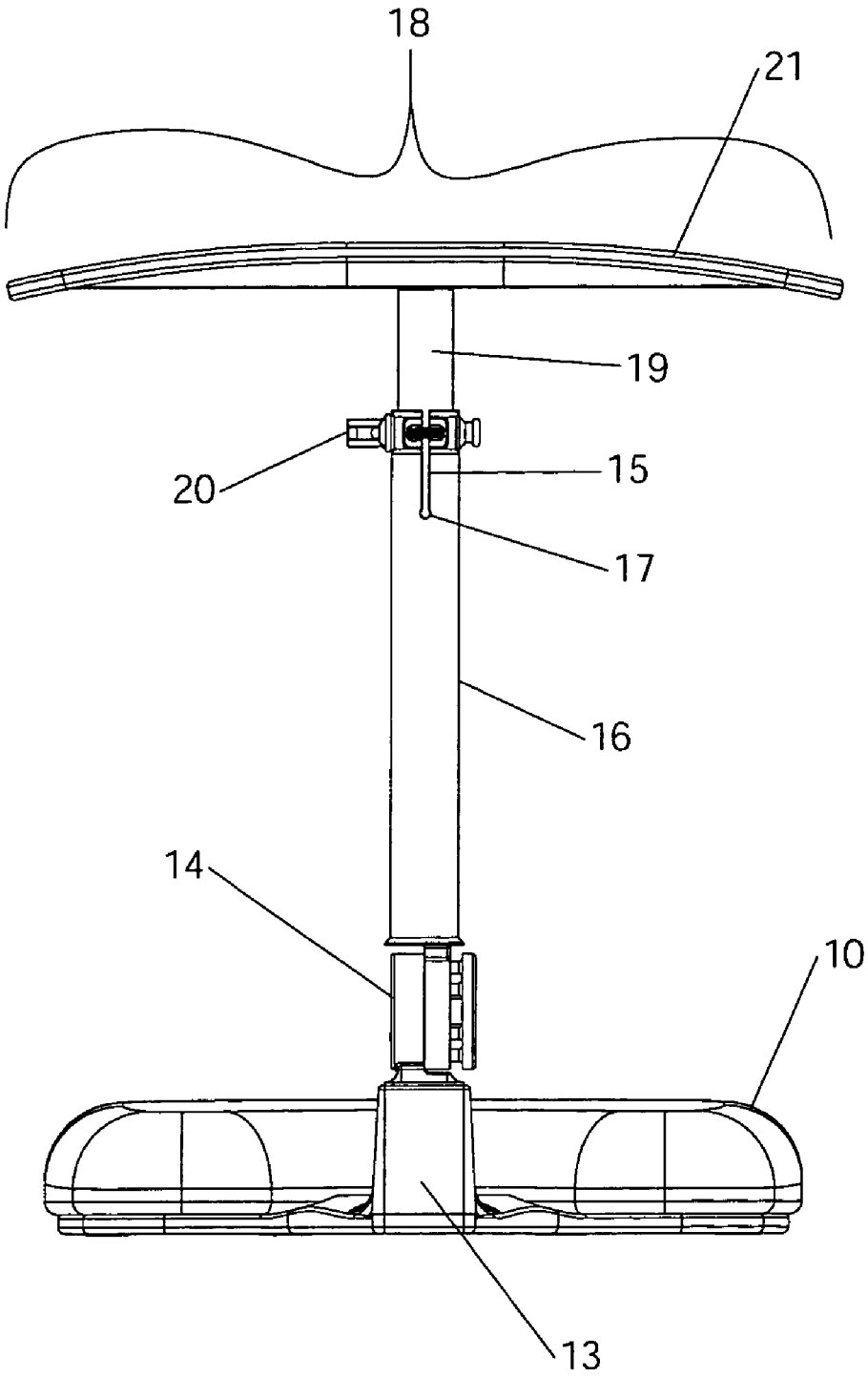
FIG. 3 shows an orthogonal front view of the portable forward leaning stadium seat with the adjustable ergonomic torso rest in an upright position.
Figure 4:
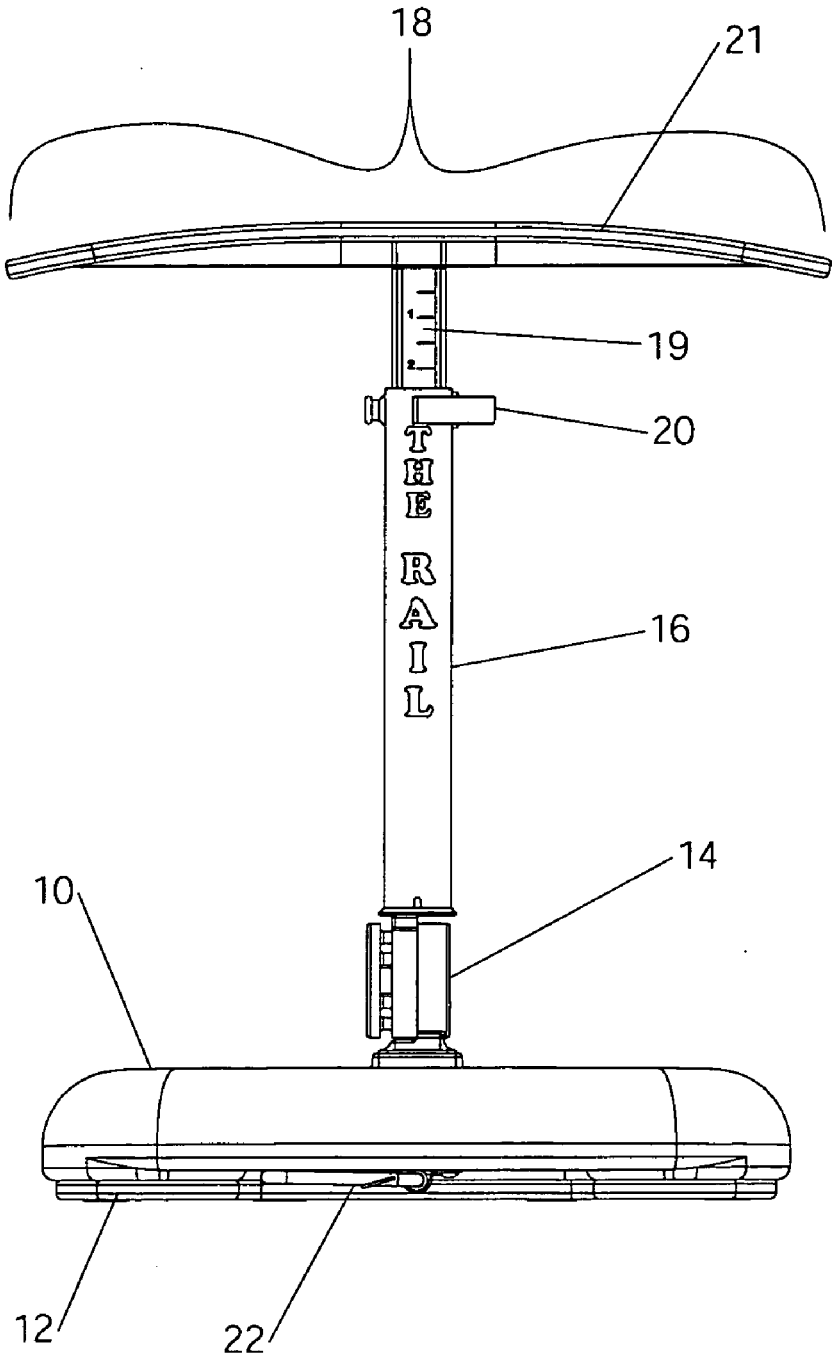
FIG. 4 is an orthogonal rear view of the portable forward leaning stadium seat with the adjustable torso support in the upright position.

The T-shaped ergonomically shaped arm rest support 18, as seen in FIGS. 3 and 4 has a flat curved horizontal upper portion 21 attached as one piece to a perpendicular half moon shaped vertical shaft portion 19 which is housed in the hollow tubular vertical support sleeve 16. The T-shaped ergonomically shaped arm rest support 18 is of the dimension compatible with stadium style seating in that its size does not interfere with the personal space allowed for human spectator occupants on either side of the occupant sitting upon the forward leaning stadium of the present invention. This configuration allows for many portable forward stadium seats to be conveniently used side by side.

Operation of the improved Portable Forward Leaning Stadium Seat is easy and straight forward. First, connect the seat frame 12 to the stadium bleacher bench by attaching the spring loaded metal hook 22 to the undersurface of the bleacher making sure the horizontal arm rest 18 is placed at the forward edge of the bleacher bench. Next, push the button on the spring loaded pushbutton rotary adjustable locking and unlocking device 14 to move the hollow tubular vertical support sleeve 16 in an open 90 degree or greater configuration compared to the flat bleacher bench surface. Sit down on the skin covered foam pad 10 with the hollow tubular vertical support sleeve 16 positioned between the user's thighs. Adjust the height of the horizontal arm rest 18 by loosening the quick release lock clasp 20 and move the arm rest 18 to the desired position and relock the quick release lock clasp 20. The user should now be able to comfortably place his or her forearms onto the horizontal arm rest 18, thereby providing support to the user's torso. The spring loaded metal hook 22 employed to the undersurface of the bleacher bench more fully secures the portable forward leaning stadium seat while the occupant sits during the sporting event. The rubberized buttons 26 prevent the portable forward leaning seat form sliding on the top surface of the stadium bleacher bench. Place any standard sized beverage cup into the cup holder 24 for ease of access and avoidance of spillage.

Accordingly, it can be seen that, according to the invention, I have provided a new portable forward leaning seating device which allows a user a more comfortable, safer, easier to use method of forward leaning support while sitting at sporting events on a bleacher type seat. Thereby, the forward leaning seating device has been improved to allow the user to more easily have access to a beverage cup while incorporating the ease of pushbutton quick release control of the ergonomically designed support.

Although the description above contains many specifications, these should not be construed as limiting the scope of the invention, but merely as providing illustrations of the presently preferred embodiments of the invention. Various other embodiments and ramifications are possible within its scope. For example, the material used to build the device can be of metal, plastic, vinyl, cloth, nylon, wood, synthetic, or composite. Further, the system used to provide for forward leaning support need not be limited to a single central vertical support sleeve 16, but may be provided by side support struts and the vertical support strut, which includes the hollow tubular support sleeve 16 and the ergonomic horizontal arm rest 18 do not need to be adjustable by a lock clasp 20, but may comprise one length, which is not adjustable. Also, the horizontal arm/torso support 21 need not be flat and fixed, but may be round, curved, foldable, or any other ergonomically shaped configuration. The push button adjustable rotary locking and unlocking device 14 can be configured to allow anterior and posterior movement of the hollow tubular support sleeve 16 utilizing interlocking teeth, cogs, gears, pins, friction, hydraulics, or springs.

Thus the scope of the invention should be determined by the approved claims and their legal equivalents, rather than by the examples given.

What is claimed is:

1. A forward leaning stadium seat, comprising:

a rigid seat frame having a front cupola projection portion, rear portion, bottom surface, and top surface;

a skin covered foam padded rigid substrate having a bottom surface, top surface, front portion, and rear portion;

means for attaching said rigid seat frame to the bottom surface of said skin covered foam padded rigid substrate;

a T-shaped ergonomic arm rest;

a spring loaded adjustable rotary locking and unlocking device;

a hollow tubular vertical support sleeve providing a lumen which runs the full length of said hollow tubular vertical support sleeve;

said hollow tubular vertical support sleeve with means to securely attach to said spring loaded adjustable rotary locking and unlocking device;

said T-shaped ergonomic arm rest having means to slidably move longitudinally, but not circumferentially, within the lumen of said hollow tubular vertical support sleeve;

a spring loaded metallic hook with means to fasten to the rear bottom surface of said foam padded substrate for attaching the forward leaning stadium seat securely to a stadium bleacher; and a plurality of rubberized buttons fixed to the undersurface of said seat frame to provide gripping contact to the seating surface of a bleacher to which the forward leaning stadium seat is attached.

2. A forward leaning stadium seat according to claim 1, wherein said skin covered foam padded substrate, said rigid seat frame, said T-shaped ergonomic arm rest, said hollow vertical support sleeve, and said spring loaded adjustable rotary locking and unlocking device are comprised of polymeric material selected from the group comprising polyethylene; polypropylene; polystyrene; polyesters; polyterephalates; nylon; glass impregnated nylon; and copolymers thereof.

3. A forward leaning stadium seat according to claim 1, wherein an aperture penetrating the thickness of said seat frame provides a cavity to allow placement of a beverage cup.

4. A forward leaning stadium seat according to claim 1, wherein the rear bottom surface of said skin covered foam padded rigid substrate provides an attachment site for said spring loaded hook.

5. A forward leaning stadium seat according to claim 1, wherein said rigid seat frame is made of a material selected from the group comprising foamed and skinned polyethylene; polypropylene; polystyrene; polyesters; polyterephalates; nylon; glass impregnated nylon; and copolymers thereof; moldable into a solid single piece.

6. A forward leaning stadium seat according to claim 1, wherein said skin covered foam padded rigid substrate is covered by waterproof material.

7. A forward leaning stadium seat according to claim 1, wherein said rigid seat frame is made of a material having the physical dimensions congruent with stadium bleacher style seating.

8. A forward leaning stadium seat according to claim 1, wherein said spring loaded adjustable rotary locking and unlocking device is securely fastened to said front cupola projection.

9. A forward leaning stadium seat according to claim 1, wherein said hollow tubular vertical support sleeve is securely fastened to said spring loaded adjustable rotary locking and unlocking device.

10. A forward leaning stadium seat according to claim 1, wherein said T-shaped ergonomic arm rest is of the physical dimensions congruent with stadium bleacher style seating.

11. A forward leaning stadium seat according to claim 1, wherein said hollow tubular vertical support sleeve forms a channel whereby a quick release locking clasp is attached.

12. A forward leaning stadium seat according to claim 1, wherein said quick release locking clasp is of a congruent size and shape to be positioned within said channel.

13. A forward leaning stadium seat according to claim 1, wherein said hollow tubular vertical support sleeve provides at least a notch extending proximally from the distal end of said hollow tubular vertical support sleeve through said channel that holds said quick release locking clasp.

14. A forward leaning stadium seat, comprising:

A quadrilateral shaped skin covered foam padded rigid substrate with a bottom surface, top surface, front portion, and rear portion;

a rigid seat frame having a front cupola projection portion, rear portion, top surface, and bottom surface with a means to attach said rigid seat frame to the undersurface of a skin covered foam padded rigid substrate;

a metallic spring loaded hook device wherein the hook device is attached to the rear bottom surface of said skin covered foam padded rigid substrate with means for attaching said stadium seat to a stadium style bleacher;

a spring loaded adjustable rotary locking and unlocking device with push button means for adjusting the angular position of an arm rest attached thereto;

a hollow tubular vertical support sleeve with a means for attaching said hollow tubular vertical support sleeve to said spring loaded adjustable rotary locking and unlocking device;

a T-shaped ergonomic arm rest with means to slidably move longitudinally, but not circumferentially, within the lumen of said hollow tubular vertical support sleeve;

a quick release locking clasp with means to allow up and down movement of said T-shaped ergonomic arm support device within the confines of said hollow tubular vertical support sleeve; and multiple rubberized buttons with means to attach said rubberized buttons to the bottom surface of said rigid seat frame.

15. A forward leaning stadium seat according to claim 14, wherein said rigid seat frame is a flat rigid quadrilateral shaped piece of polymeric material selected from the group comprising: polyethylene; polypropylene; polystyrene; polyesters; polyterephylates; nylon; glass impregnated nylon; and copolymers thereof; moldable into a single piece.

16. A forward leaning stadium seat according to claim 14, wherein said rigid seat frame is fastened to the bottom surface of said skin covered foam padded rigid substrate.

17. A forward leaning stadium seat according to claim 14, wherein said rigid seat frame forms a front cupola projection portion.

18. A forward leaning stadium seat according to claim 14, wherein a plurality of rubberized buttons fixably attach to the bottom surface of said rigid seat frame to provide non-skid contact to the seating surface of a stadium style bleacher which said forward leaning stadium seat is attached.

19. A forward leaning stadium seat according to claim 14, wherein an aperture penetrating the thickness of said rigid seat frame provides a cavity to allow placement of a beverage cup.

20. A forward leaning stadium seat according to claim 14, wherein an indention to the rear portion of said rigid seat frame allows an attachment site for said metallic spring loaded hook to said skin covered foam padded rigid substrate.

21. A forward leaning stadium seat according to claim 14, wherein the skin covering of said foam padded rigid substrate is made of a substrate of polymeric material selected from the group comprising: foamed and skinned polyethylene; polypropylene; polystyrene; polyesters; polyterephylates; nylon; glass impregnated nylon; natural or synthetic textile materials and copolymers thereof.

22. A forward leaning stadium seat according to claim 14, wherein said foam padded substrate is covered by waterproof material.

23. A forward leaning stadium seat according to claim 14, wherein said skin covered foam padded rigid substrate has the physical dimensions congruent with stadium bleacher style seating.

24. A forward leaning stadium seat according to claim 14, wherein said spring loaded adjustable rotary locking and unlocking device has means for attaching to said forward cupola projection.

25. A forward leaning stadium seat according to claim 14, wherein said hollow tubular vertical support sleeve has means for attaching to said spring loaded adjustable rotary locking and unlocking device.

26. A forward leaning stadium seat according to claim 14, wherein said T-shaped ergonomic arm rest is of the physical dimensions congruent with stadium bleacher style seating.

27. A forward leaning stadium seat according to claim 14, wherein said hollow tubular vertical support sleeve forms a channel whereby said quick release locking clasp attaches by means of a nut and bolt.

28. A forward leaning stadium seat according to claim 14, wherein said quick release locking clasp is of a congruent size and shape to be positioned within said channel.

29. A forward leaning stadium seat according to claim 14, wherein said hollow tubular vertical support sleeve provides at least a notch extending proximally from the distal end of said hollow tubular vertical support sleeve through said channel with a means for holding said quick release locking clasp.

* * * * *